United States Patent [19]

May et al.

[11] Patent Number: 5,056,862

[45] Date of Patent: Oct. 15, 1991

[54] RECESSED LEVER ACTUATOR FOR RECLINER MECHANISM

[75] Inventors: Teddy J. May; Steve R. Robison, both of Tupelo, Miss.

[73] Assignee: Action Industries, Inc., Tupelo, Miss.

[21] Appl. No.: 547,221

[22] Filed: Jul. 3, 1990

[51] Int. Cl.[5] ..... A47C 1/02

[52] U.S. Cl. ..... 297/85; 297/68

[58] Field of Search ..... 297/68, 83–85, 297/88, 89, 321, 322, 329

[56] References Cited

U.S. PATENT DOCUMENTS

| | | |
|---|---|---|
| 1,344,128 | 6/1920 | Griffiths . |
| 1,699,452 | 1/1929 | Schlossberg et al. . |
| 2,624,613 | 1/1953 | Parmely . |
| 2,776,702 | 1/1957 | Belisle . |
| 2,833,336 | 5/1958 | McGregor . |
| 3,047,321 | 7/1962 | Gander . |
| 3,055,706 | 9/1962 | Van Der Meer et al. . |
| 3,475,051 | 10/1969 | Crawford . |
| 3,730,585 | 5/1973 | Rogers, Jr. et al. . |
| 3,778,103 | 12/1973 | Edwards . |
| 3,904,240 | 9/1975 | Rogers, Jr. et al. . |
| 3,993,338 | 11/1976 | Cherbourg et al. . |
| 3,993,339 | 11/1976 | Cherbourg et al. . |
| 4,025,094 | 5/1977 | Mitchell . |
| 4,038,718 | 8/1977 | Reilhac et al. . |
| 4,420,954 | 12/1983 | Hieronymi et al. . |
| 4,494,793 | 1/1985 | Rogers, Jr. . |
| 4,506,926 | 3/1985 | Griggs, Jr. . |
| 4,530,529 | 7/1985 | Poe et al. . |
| 4,531,778 | 7/1985 | Rogers, Jr. . |
| 4,570,995 | 2/1986 | Rogers, Jr. . |
| 4,580,822 | 4/1986 | Fukumoto . |
| 4,668,009 | 5/1987 | Talley et al. . |
| 4,690,454 | 9/1987 | Mizelle ..... 297/85 X |
| 4,696,512 | 9/1987 | Burnett et al. . |
| 4,707,025 | 11/1987 | Rogers, Jr. . |
| 4,747,632 | 5/1988 | Joy . |
| 4,834,433 | 5/1989 | Keller . |
| 4,838,590 | 6/1989 | Isomura . |

FOREIGN PATENT DOCUMENTS

| | | |
|---|---|---|
| 0218502 | 4/1987 | European Pat. Off. . |

*Primary Examiner*—Peter R. Brown

*Attorney, Agent, or Firm*—Cushman, Darby & Cushman

[57] ABSTRACT

A reclining chair having a mechanism which releasably locks with the chair in its fully erect condition, is provided on one of its arms, with a recessed lever-type actuator. In general, the actuator strongly resembles the latch release presently conventionally found on the inner sides of doors on many makes of automobiles. The lever connects by cable with a lock release which, when rotated by rotation of the lever frees the mechanism to operate for reclining the chair. The actuator assembly includes a backing plate for mounting the actuator to a chair arm, for fitting the cable sheath, and for preventing accidental disassembly of the lever housing. The assembly can be mounted on left or right sides of chairs. The lock release also preferably acts as a drive to initiate movement of the mechanism from the closed position upon unlocking, and tensions the cable for providing a re-latching function as the mechanism is closed by the user.

6 Claims, 5 Drawing Sheets

RECESSED LEVER ACTUATOR FOR RECLINER MECHANISM

BACKGROUND OF THE INVENTION

In the recliner industry, more broadly in the motion seating furniture industry, it is conventional to provide chair or equivalent article of seating furniture with a base, and a seating construction mounted on the base by means of a mechanism which permits the user to move the seating construction, or part of it, in relation to the base, in order to selectively achieve each of two, three or more different positions. For instance, the seating construction may include a seat and arm frame unit, an ottoman, and a backrest. Such a recliner may have a fully upright condition, in which the backrest is erect and the ottoman is stowed, a TV position, in which the ottoman is fully projected but the backrest remains erect, or nearly so, and a fully reclined position, in which the ottoman remains fully projected and the backrest is reclined. The movement between positions is accomplished by operation of a system of mechanical linkages (a recliner chair mechanism) which also mounts the ottoman and backrest to the seat and arm frame unit, and the seat and arm frame unit to the base. In some constructions, the seat and arm frame unit translates forwardly and/or tilts front up/back down and/or raises or lowers relative to the base as the mechanism is operated. In some recliners, the seat and arm frame unit is rigidly mounted to the backrest, so that reclining is achieved by tilting that combined structure bodily.

The present invention is concerned with such seating furniture regardless of whether it is in the form of a free-standing one-seat chair, or a one-armed one-seat modular unit for use with other modules as part of a modular sofa grouping, or a connected end unit of a multiple-seat article of seating furniture, such as a love seat or sofa. The term "recliner" or reclining chair is used herein as being generic to all such articles.

Although there are some recliner chairs in which one "pushes off the arms", (i.e., sits in the chair and pushes back on the backrest with ones back while grasping the chair arms and pushing forwards on them), such chairs have known limitations (after a certain amount of use, they may, when unoccupied, tend to assume a partly reclined condition instead of a fully erect condition, because their joints have gotten loose and nothing is available to latch the parts in a fully erect position). Accordingly, most recliner chairs make use of an actuator to initiate and/or control operation of the mechanism for reclining and/or erecting the chair, and the actuator provides a latch for defining the fully erect condition of the chair.

In recent years, there have been at least two waves of popularity of electrically operated recliner chairs, ones having a motorized mechanism the electrical drive motor for which is operated using a switch which may be mounted on the inside, outside or front of an arm of the chair. The present invention relates, rather, to non-electrical manually operated mechanisms.

The lost common actuators for recliners are: a large crank handle on the outside of the left or right arm of the chair (usually near the floor, but within grasp of a typical person seated in the chair), a similar but smaller release handle, a push botton (located somewhere on one of the chair arms, e.g., on the inner side, outer side, front or top of an arm), and a ring pull release protruding up between a side edge of the seat cushion and an arm.

Some of the diversity in type and placement of actuators is due to the fact that each of the conventionally used actuators has drawbacks, and so recliner designers have constantly attempted to find a better way to actuate a recliner mechanism. Protruding handles work well, but can bark shins and can catch on many objects as a chair is moved. They constrain a chair's design, since their medially directed leg must rotate about its own longitudinal axis and not translate relative to the chair arm as the handle is rotated, in order to permit upholstering of the chair arm.

Inside arm handles, push buttons and ring-pull actuators find use in certain instances, but some consumer's shown chairs having such actuators, because the actuators are too difficult for them to find and operate when seated in such chairs.

Prior art push button-type actuators have found limited acceptance, because many of them protrude too far, provide limited travel and thereby limited drive transmitted to the chair mechanism and/or are difficult to push.

SUMMARY OF THE INVENTION

A reclining chair having a mechanism which releasably locks with the chair in its fully erect condition, is provided on one of its arms, with a recessed lever-type actuator. In general, the actuator strongly resembles the latch release presently conventionally found on the inner sides of doors on many makes of automobiles. The lever connects by cable with a lock release which, when rotated by rotation of the lever frees the mechanism to operate for reclining the chair. The actuator assembly includes a backing plate for mounting the actuator to a chair arm, for fitting the cable sheath, and for preventing accidental disassembly of the lever housing. The assembly can be mounted on left or right sides of chairs. The lock release also preferably acts as a drive to initiate movement of the mechanism from the closed position upon unlocking, and tensions the cable for providing a re-latching function as the mechanism is closed by the user.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

It is not necessary to understand in detail any particular recliner chair or recliner chair mechanism in order to gain an adequate understanding of the present invention. Indeed, the actuator of the present invention may be used with a wide variety of different mechanical designs of recliner chairs and recliner chair mechanisms. Nevertheless, in order to ensure that a best mode is presented, the actuator is disclosed herein in relation to an exemplary mechanical design of recliner chair and recliner chair mechanism. However, in view of the fact that the mechanism and chair, apart from the novel actuator are conventional, the description of the conventional structure is abbreviated.

Figures 1, 1A:
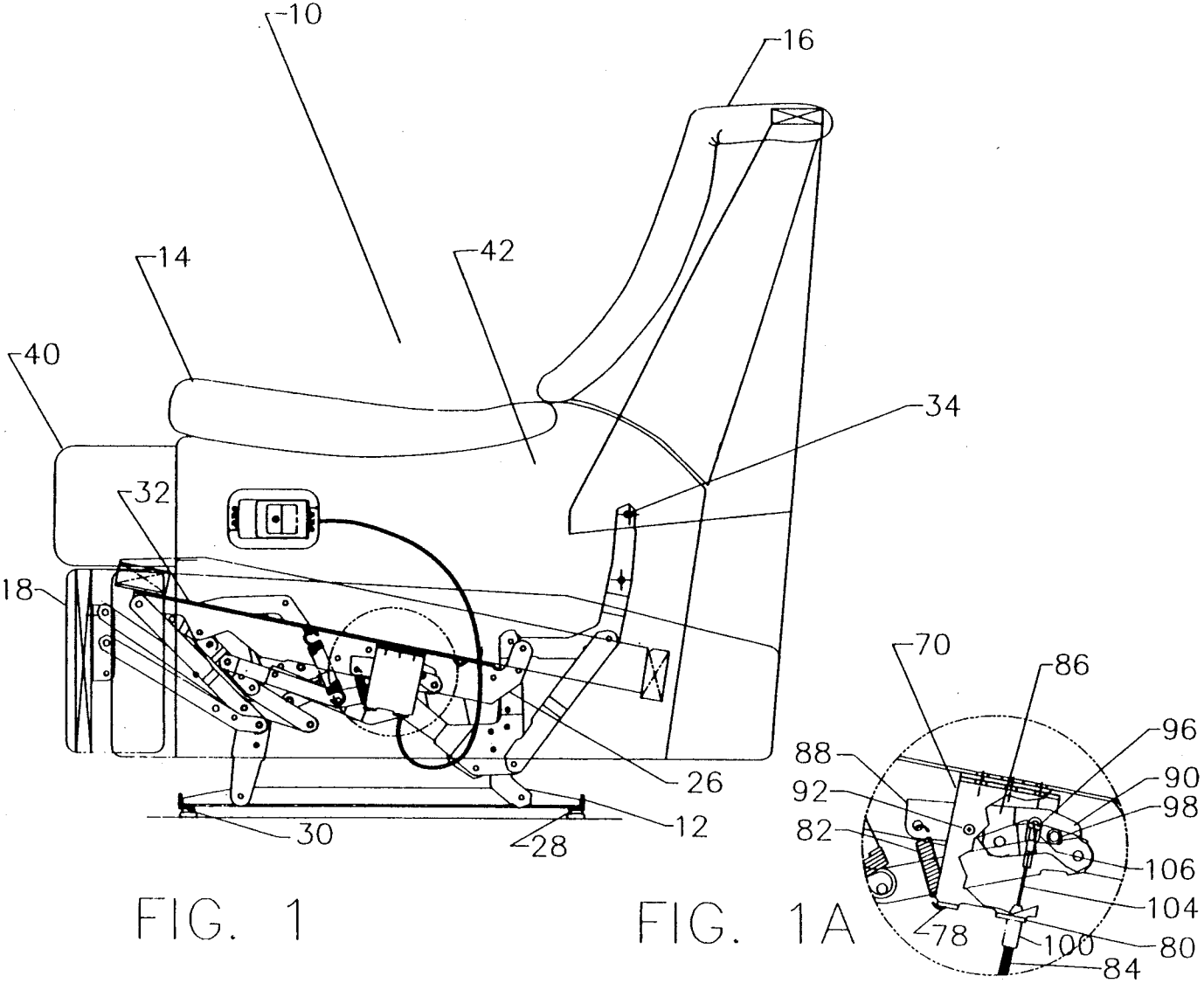
FIG. 1 is a side elevation view of a recliner chair equipped with a recessed lever actuator for its recliner mechanism, in accordance with principles of the present invention. (In this figure, and in FIG. 2, the outlines of the upholstered set and arm frame unit, backrest and ottoman are super-imposed on the mechanism and actuator in order to indicate the combination of these elements. In actual practice, the chair structure and upholstery hides most of the mechanism, as should be apparent.) In this view, the mechanism lock is locked.
FIG. 1A is a larger scale fragmentary side elevation view of the portion including the lock end of the actuator that is circled in FIG. 1, with its mounting bracket partly broken away to show details otherwise obscured thereby.
Figures 2, 2A, 2B:
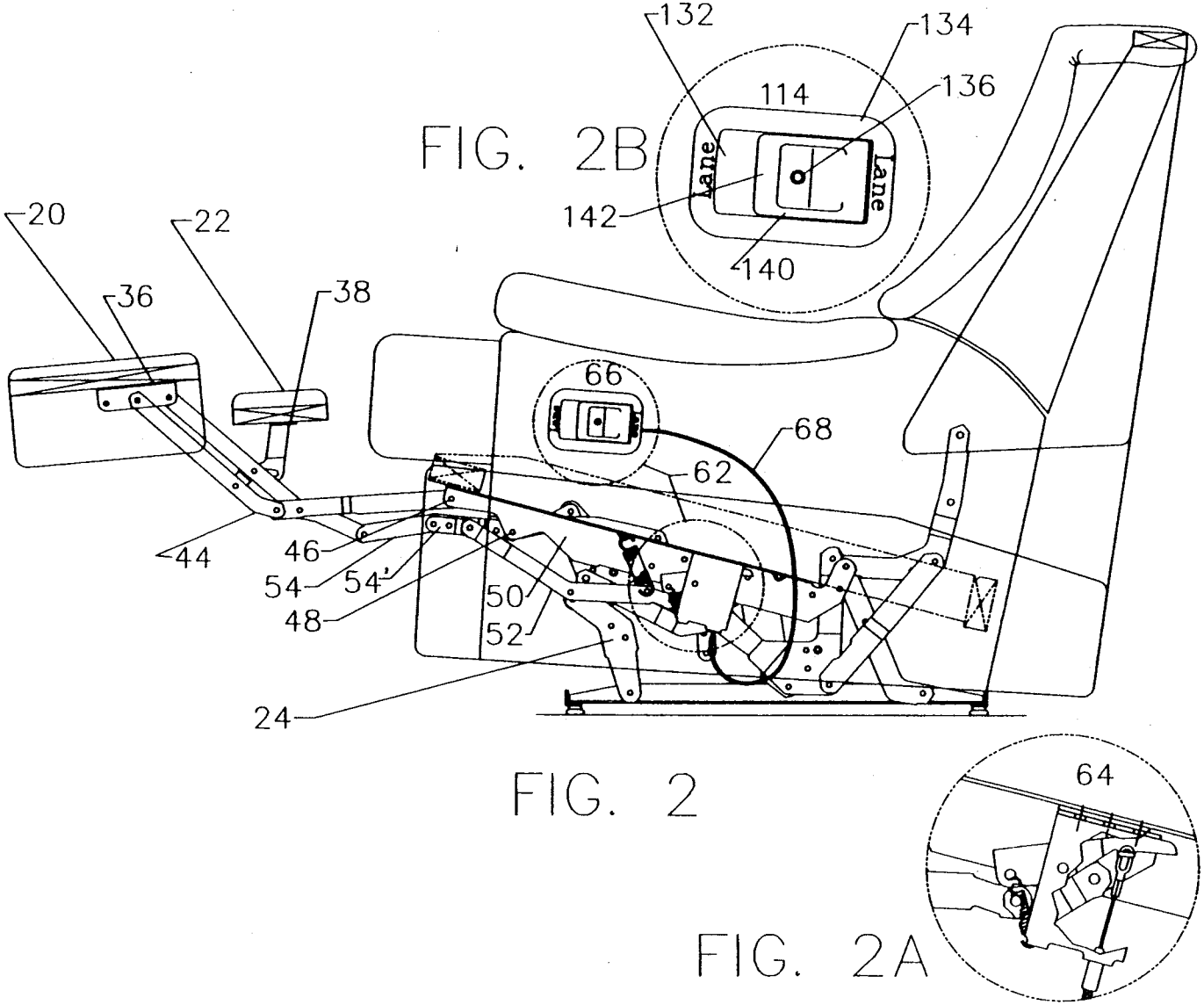
FIG. 2 is a side elevation view similar to FIG. 1, except that the actuator lever having been pulled and released, the mechanism lock is unlocked and the occupant (not shown) has moved the chair to its TV position.
FIG. 2A is a larger scale fragmentary side elevation view similar to FIG. 1A, of the lower circled area in FIG. 2.
FIG. 2B is a larger scale fragmentary side elevational view showing the lever and its housing as visible on the chair arm.
Figure 4:
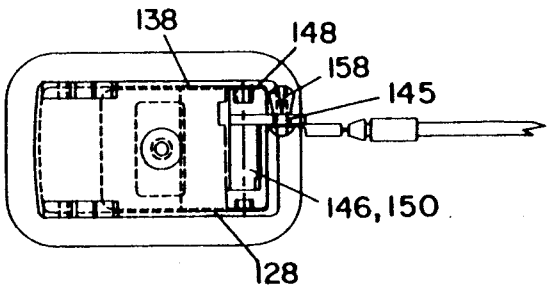
FIG. 4 is a inner side elevational view of the lever-end assembly of the apparatus, with the mounting plate omitted.
Figure 3:
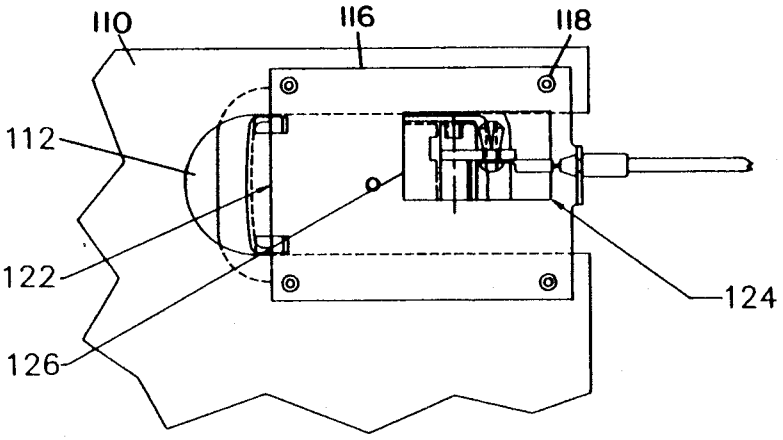
FIG. 3 is a fragmentary inner side elevation view of a frame panel of the arm of the seat and arm frame unit, showing the back side of the lever-end assembly of the apparatus of the present invention as mounted thereto.

In FIGS. 1 and 2, a recliner chair is shown at 10.

The chair 10 includes a base 12 adapted to be supported on a floor, an upholstered seat and arm frame unit 14, an upholstered backrest 16 and an upholstered ottoman 18 (shown including a primary legrest 20 and a secondary legrest 22) and a mechanism 24.

In the instance depicted, the base 12 and mechanism 24 form part of an integrated assembly. These elements typically are made of cut, bored and bent steel plate elements with rigid connections made by rivets and pivotal connections made by transverse, horizontal axis pivot joints. Some stops may be provided by tangs bent from the link material, others by press fit pins. Washers, clips, bushings and similar elements are used, as conventional. Many links are multiply bent, in order to place opposite ends in different planes, avoid interference with movement of other links, and/or to provide flanges extending at an angle to a remainder. Most longitudinal links have their thickness direction extending transversely of the chair. Some securements may be provided in the form of screws or nuts and bolts.

Although not depicted, it is believed it will be clear to those skilled in the art that the mechanism 24 comprises a left side linkages and a right side linkage, which are mirror images of one another and located near respectively opposite sides of the chair, and transversely extending members which connect certain respective elements of the two side linkages, in order to provide bracing and coordinate movement of the respective links on the two sides as the mechanism is operated. In FIGS. 1 and 2, the near side is the left side. Accordingly, the left side linkage 26 is shown, and blocks view of the mirror image right side linkage.

In general, the mechanism 24 provides two functions.

First, it unites the other chair components into a chair. It is mounted to the base 12 at 28, 30. The upholstered seat and arm frame unit 14 is mounted to the mechanism at 32. The backrest 16 is mounted to the mechanism at 34. And the primary and secondary legrests of the ottoman 18 are mounted to the mechanism 24 at 36 and 38, respectively.

Second, the mechanism 24, which is a system of interpivoted links, by coordinated movement of its links relative to one another, repositions the chair components relative to one another so that the chair, in use, can be selectively placed in each of three positions, namely the fully erect position that is shown in FIG. 1, the TV position that is shown in FIG. 2, and the fully reclined position (which is not depicted).

In the fully erect (FIG. 1) position, the mechanism 24 is "closed", i.e,. maximally folded, so that the ottoman 18 is stowed under the front lip of the upholstered seat cushion 40 of the seat and arm frame unit 14, the seat and arm frame unit 14 is disposed at a certain level above the floor over the base 12, and the backrest 16 is erect between and above the upholstered left and right arms 42 of seat and arm frame unit, at the rear of the cushion 40.

As can be seen by comparing FIGS. 1 and 2, as the chair moves from its fully erect position to its TV position, due to coordinated movement of certain of the interpivoted links of the mechanism 24, the ottoman is thrust forwards and raised, and the set and arm frame unit is moved bodily forward, and is lowered at the rear, so that the attitude of the occupant support surface of the seat cushion and backrest are tilted backwards somewhat.

In going from the TV position of FIG. 2, to the fully reclined position which is not shown, the top of the backrest tilts down to the rear and the seat and arm frame unit is raised somewhat. For returning to the TV position, the occupant shifts his or her weight from their back to their bottom, causing the backrest to reerect as the seat and arm frame unit is pushed back down to the FIG. 2 position.

The user can return the chair from the TV position (FIG. 2) to the fully erect position (FIG. 1), by pulling rearward and down on the primary ottoman with their heels and/or leg backs.

Figure 5:
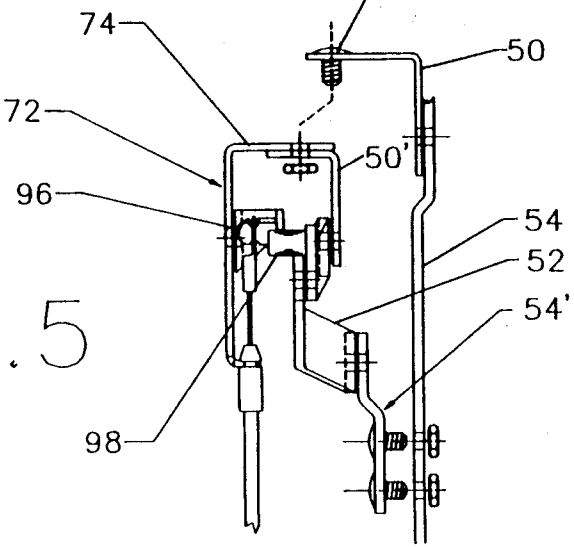
FIG. 5 is a fragmentary, exploded rear elevational view of the lock-end assembly of the apparatus, in relation to the recliner mechanism, the tension spring of the lock-end assembly having been omitted from this view.

The subsystem of linkages of the left and right side linkages on which the ottoman is mounted is shown being conventional pantographic linkages 44, the upper ends of the rear links of which are pivotally secured at 46, 48 to the seat mounting plates 50. An ottoman driving link 52 provided on one of the side linkages has its forward end pivotally secured at an intermediate height level to a bracket 54' which is bolted to the rearmost rear link 54 of the respective pantographic linkage 44 (FIG. 5). As is apparent from FIGS. 1, 2, 6 and 7, as the link 52 is moved forwardly and down, while remaining generally horizontal, the pantographic linkages project forwardly, extending the ottoman. And, as the driving link 52 is moved rearwardly and up, while remaining generally horizontal, the pantographic linkages 44 are retracted rearwardly, stowing the ottoman.

The rear of the driving link 52 is not pivoted directly to the respective lock mounting bracket 50'. Rather, it is pivotally secured to one end of a respective comparatively short lock link 56, and the opposite end of the lock link 56 is pivotally secured to the vertical flange of the respective lock mounting bracket 50', at a location which is closer to the front pivot joint of the ottoman during link 52 than the distance between the front and rear pivot joints on the ottoman driving link 52.

Accordingly, when the ottoman driving link 52 is in its upper, locked condition (shown in FIGS. 1 and 6), the lock link 56 doubles back along side the rear end portion of the ottoman driving link 52.

Figure 6:
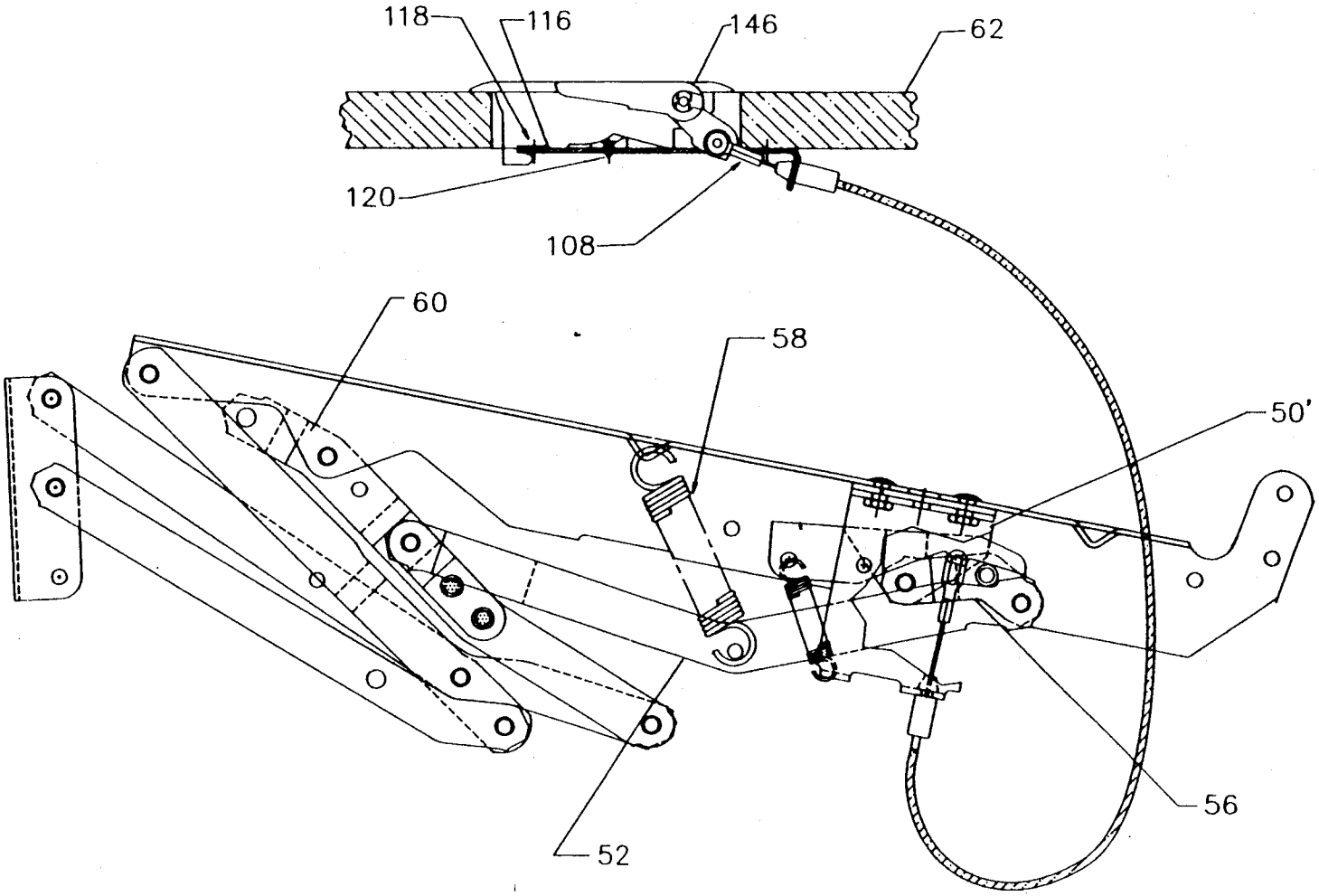
FIG. 6 is a larger scale view similar to FIG. 1, except that most of the upholstered chair and some of the mechanisms have been omitted, and the lever-end assembly is shown in top plan view; in relation to a horizontal cross-section of the seat and arm frame unit panel in which it is mounted.

A tension coil spring 58 connected between intermediate sites on the ottoman driving link 52 and the horizontal flange of the seat mounting plate tends to maintain the mechanism 24 fully closed (i.e., in the position shown in FIGS. 1 and 6).

In the positions shown in FIGS. 1 and 6, the mechanism 24 is locked against opening, because the pivot of the ottoman driving link to the lock link is located on line with or above the pivot of the lock link to the set mounting plate. (A reminder: but for the lock and the ottoman drive, the components of the left side linkage shown are duplicated in mirror image in the right side linkage, and transverse bars, e.g., provided at 60 interconnect some respective components and ensure that the right and left side linkages move in a corresponding manner.)

No amount of an occupant's pushing or pulling forwards and backwards on the chair arms, bouncing on the seat cushion or leaning back on the backrest will cause the ottoman to extend.

The nature of the lock is similar to the way that a soldier's knees are locked when standing at attention. And the actuator functions much in the same way to break the lock as does clipping the soldier behind his or her knees, causing him or her to buckle at the knees.

In the instance of the mechanism 24, all that is needed for unlocking the lock is for "something", to rotate the rear end of one of the lock links 56 down until its pivotal connection to the rear of the ottoman during link is at least slightly below the pivotal connection of the lock link to the seat mounting plate.

The "something" for causing the necessary rotation, is the actuator 62 of the present invention.

Figure 7:
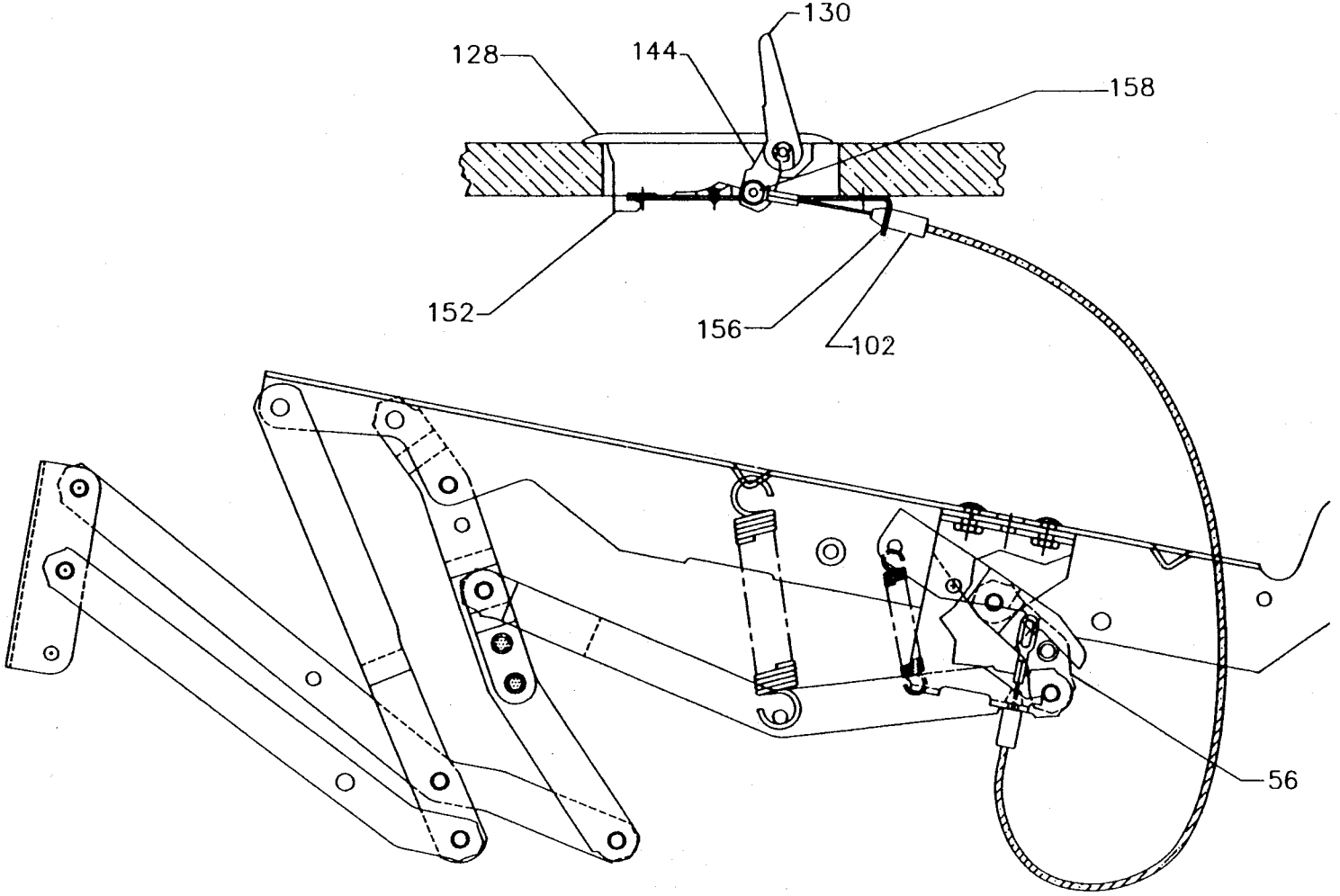
FIG. 7 is a view similar to FIG. 6, but depicting a stage that is intermediate to the ones depicted in FIGS. 1 and 2. That is, the lever has been pulled out, thus releasing the lock, and initiating opening of the mechanism, although the TV position has not yet been full attained.

In general, the actuator 62 of the present invention is an assembly having a lock end 64, a lever end 66 and a sheathed flexible cable 68 interconnecting the two ends. Actuation of the lever end of the actuator longitudinally moves the cable, causing the lock end to pull down on one of the lock links 56 behind the pivotal connection of that lock link to the lock mounting bracket 50'. The downward pull is of sufficient magnitude to sufficiently lower the pivotal connections of the lock links to the rear ends of the respective ottoman driving links, whereupon the chair occupant's weight as the occupant concentrates their weight on the chair seat and tends to lean on one chair arm opposite to the one on which the actuator lever end is mounted, causes the ottoman to be thrust, placing the chair in its TV position (FIGS. 2 and 7).

In reverse, as the occupant wants to close-up the chair to its erect position, he or she pulls down and in on the ottoman with the backs of his or her legs initiating retraction. As the mechanism 24 folds, the tension springs 58 raise the ottoman driving links 52 sufficiently to place the rear pivotal connections of the ottoman driving links 52 to the lock links on a level with or above the pivotal connections of the locking links to the seat mounting plates, thereby re-locking the lock.

The structure of the actuator 62 is the illustrated preferred embodiment will now be described in greater detail.

The lock end 64 of the actuator includes a mounting bracket 70 having a main, vertical flange 72, an upper horizontal flange 74, by which the bracket 70 is secured to a respective one of the seat mounting plates 50 at 76. Two transverse tangs 78, 80 are formed on the lower end of the bracket flange 72. The tang 80 is configured to permit the lock end of the sheath 84 for the flexible cable assembly 68 to be mounted to the bracket 70.

The lock end 64 of the actuator further includes a lock lever 86 shown in the form of a cut, bored and bent steel plate having a forward end portion 88 and a rear end portion 90 relative to an intermediate portion which is pivotally secured to the bracket flange 72 at 92. The forward end portion of the lock lever 86 is connected by the upper end of the spring 82 to the forward tang 78. Accordingly, the spring 82 tends to keep the lock lever cocked in the position show in FIG. 1A and 6 (down at the forward end, up at the rear end). If the rear end is pulled down and released, the spring 82 pulls the lock lever 86 back to the position shown in FIGS. 1A and 6.

The lock link 56 is shown having a transverse, horizontal axis pin 98 projecting in an outbound direction from a location thereon which is intermediate the ends thereof. (In fact, this pin needs to be provided on only one of the side linkages of the chair 10, but, in order to permit versatility in assembly, i.e., to permit a choice to be made on the chair assembly line as to which chair side to provide the actuator on, both side linkages could be provided with locks, although this is not preferred. The pins 98 can be a press-fitted element as shown. Alternatively, it could be a tang bent from the metal plate of the lock link itself. Or, the interaction between the lock link and actuator could be provided in any equivalent manner, e.g., a keeper slidable in slot.) At a site intermediate the pivotal connection 92 and the rear tip 90 lock lever 86, a tang 96 bends transversely horizontally outboards. This tang has two opposed grooves for permitting a cable end 106 to be attached. The tang 96 is disposed vertically above the cable sheath mounting tang 80.

When the bracket 70 is mounted as shown the lock lever rear tip 90 is disposed directly over and adjacent the pin 98 on the lock link. Pulling down on the tang 96 causes the lock lever rear tip 90 to engage and pull down on the pin 98, thus rotating the lock link 56 downwards enough to allow the mechanism 24 to open up from its FIG. 1 position to its FIG. 2 position (as described above).

The flexible cable assembly 68 may be of the same kind as is now conventionally used for connecting between automotive door internal handles and door latches. In particular, it is shown including a flexible sheath 84 having a mounting fitting 100, 102 at each end. The lock end fitting 100 secures to the tang 80 so that its opening its directed upwards towards the tang 96 on the lock lever 86 rear end portion 90.

The sheath 84 longitudinally slidingly reclines a flexible cable 104 which protrudes beyond both end fittings of the sheath and at its opposite ends is respectively provided with a lock end fitting 106 and a lever end fitting 108. These are shown having the forms of steel eyes.

The lock end of the cable assembly 68 is easily fitted to the lock end of the actuator by turning the slotted eye 106 horizontally, slipping it onto the tang 96 and turning it vertically to secure it to the tang 96, then pushing the groove on the sheath fitting 100 into the U-shaped lower edge of the bracket 70 flange 72, tang 80.

Typically, the arms 42 of the chair are made of upholstery-over-wood framing. Typically, included in the wood framing for each arm is a vertical, longitudinally extending plywood panel 110, e.g., 0.75 inch thick. Either one of these panels (on the same side of the chair as the lock end 64), is shown provided with a slot 112 which is elongated longitudinally of the chair. The upholstery of the chair (not illustrated), is provided with an overlying opening.

The lever end 66 of the actuator 62 includes an actuator assembly 114, which is mounted in the slot 112, the outside, a mounting plate 116 which is mounted to the inner face of the respective arm panel 110 so as to bridge over the slot 112, screws 118 for mounting the mounting plate 116 to the arm panel 110, and a screw 120 for mounting the actuator assembly 114 to the mounting plate 116. The forward end of the slot 112 extends beyond the forward edge 122 of the plate 116. Near the rear edge of the plate 116, a slot 124 is provided through the plate 116, at least partially connecting with the slot 112 in the panel 110. This slot 124 has a forward edge 126. In use, the plate 116 is screwed at 118 to the innerface of the panel 110, so as to be juxtaposed with the slot 112, as shown. The arm and seat frame unit of the chair is upholstered (not shown), leaving a slot in the fabric overlying the slot 112 in the panel. (In practice, the slot in the fabric is somewhat smaller than the slot in the wood, in order to avoid leaving a gap in the upholstery around the actuator assembly 114 as seen from the outside of the completed chair 10.)

With three important exceptions that will be described below, the actuator assembly 114 may be constructed and provided as described in detail in relation to the automotive internal door handle assembly which is disclosed in the U.S Pat. No. of Fukumoto 4,580,822, issued Apr. 8, 1986.

In general, the assembly 114 includes two major molded plastic components, namely a housing 128 and a lever 130. The housing includes a cup-shaped recess 132 surrounded by a lip or bezel 134. A countersink hole 136 is provided centrally through the recess 132 to receive a screw 120 for securing the assembly 114 to the plate 116. Hidden from the outside by the trunnion region of the lever is a slot 138 through the recess 132. The lever 130 is provided in the form of a handle loop 140 which rests in the recess 132 so as to have an easily graspable web 142 transversing between two opposite edges of the recess at an intermediate site, the web 142 being much thinner than the recess 132 is deep. On the back side, on a longitudinally opposite side of the lever 130 from the handle loop 140 is a radial flange 144 based on the hinge barrel 146. The integral trunnions 148 formed on the housing in the slot 138 project towards one another and are part round, so as to permit the lever 130 to be slipped into place on the trunnions only when the lever 130 is rotated to substantial perpendicularity to the housing 128. A torsion spring 150 reclined in a recess in the hinge barrel 146 bears against the flange 144 and against the backside of the housing 128 in order to maintain the lever in its parallel-to-the-housing, nested position. The lever can be rotated out, about the trunnions, by grasping the web 142 and pulling outwards (FIG. 7), but when the web 142 is let go of, the spring 150 rotates the lever back to the fully recessed orientation shown in FIG. 6.

The thickness of the bezel 134 typically is about one-eighth of an inch.

The end of the backside of the housing 128 opposite to the end having a slot 138 is provided with two hooks 152 which open towards the slotted end of the housing. (This is one difference from the Fukumoto construction, which discloses two sets of two hooks.)

A hole 145 is shown formed transversely through the flange 144 distally of the hinge barrel 146.

In use, the actuator assembly 114 is inserted into the slot 112 from the outside, after the seat and arm frame unit has been upholstered and after the plate 116 has been screwed into place. The hooks 152 are hooked around the front edge 122 of the plate 116 and the screw 120 installed. The hooks 152 and screw 120 cooperate to mount the actuator assembly 114 to the chairs.

From the rear, the flange 144 is visible through the slot 124, but these features are so disposed relative to one another that, as the web 142 of the handle loop 140 is pulled out, the edge of the flange 144 strikes the edge 126 of the slot 124 before the handle loop 140 has reached perpendicularity with the housing 128. Thus, the edge 126 on the plate 116 prevents excessive rotation of the lever 130 (in contrast to the Fukumoto construction, in which a bumper provided directly on the back of the recess of the housing engages the lever flange to prevent over-rotation).

The mounting plate 116 further includes a tang 156 projecting transversely inwardly along its rear edge. This tang is configured with a slot for receiving an external groove in the mounting fitting 102, for securing the respective end of the cable sheath to the lever end of the actuator. (This is a third difference from the Fukumoto construction.) The lever end fitting 108 of the cable is secured to the flange 144 distally of the hinge barrel 146, e.g., by a plastic rivet 158 installed through the end fitting 108 and the hole 145 in the flange 144.

The actuator assembly 114 and plate 116 can be used interchangeably on left and right arms, by inversion of parts, and/or provision of mirror image parts. The same is true of the lock end of the actuator.

The inventor's preference is to mount the lever end of the actuator so that the handle loop 140 is accessible on the outside of an arm, and so that it has the same spatial orientation usually provided for recessed internal doors of automobile doors. However, an inverted orientation, or one which pulls up, or down is within the scope of the invention, as is mounting for accessibility on the inner side of an arm, on the front of an arm or the top of an arm.

In use, a person sits in the chair, and, upon wanting to go from the erect position to the TV position, simply grasps and pulls outwards on the handle loop 140 briefly and lets it go. The spring 150 and/or the spring 82 returns the handle to its full recessed condition.

Meanwhile, the momentary pull on the handle loop has longitudinally pulled the cable 104, which has pulled down on the rear tip 90 of the lock lever 86, thereby pulling down on the lower end of the lock link 56, releasing the mechanism 24 so that the weight and action of the occupant can cause the ottoman to be projected by the ottoman driving links 52. As soon as the handle loop 140 is released, not only does the torsion spring 150 and/or the spring 82 return the handle loop to its recessed orientation, but pension coil spring 82 re-raises the rear tip 90 of the lock lever 86.

It should now be apparent that the RECESSED LEVER ACTUATOR FOR RECLINER MECHANISM as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

We claim:

1. A mechanism lock release actuator for a recliner chair which has a seat and arm frame unit supported on a base by an occupant force operated mechanism which is reversibly movable between a closed position in which the recliner chair is erect and at least one at least partially open position in which an ottoman mounted to the mechanism is raised and forwardly thrust from a location stowed under a forward edge of a seat cushion of the seat and arm frame unit, in which the seat and arm frame unit includes at least one arm constituted at least in part by a panel having a slot provided therethrough, and in which a mechanism lock must be released by movement of a lock portion of said mechanism a certain distance in a certain direction before said occupant force can be effectively applied to move said mechanism from said closed position to said at least partially open position, said mechanism lock release actuator comprising:

a lock end portion, a lever end portion, and a flexible cable assembly;

said flexible cable assembly including:

a flexible sheath having two opposite ends;

a respective sheath mounting fitting provided at each end thereof;

a flexible cable longitudinally slidably received in said sheath and having two opposite end portions respectively protruding out of opposite ends of said sheath; and a respective cable attachment fitting secured on each end portion of said flexible cable;

said lock end portion comprising:

a bracket and means for mounting said bracket in fixed relation to said seat and arm frame unit adjacent said look portion of said mechanism;

a lock portion engaging element and means mounting said element to said bracket for movement along a path between an inactive position, and an active position in which said element, having engaged said lock portion of said mechanism has forceably moved said lock portion of said mechanism said certain distance in said certain direction;

resilient means effectively secured between said bracket and said element and operative for tending to maintain said element in said inactive position and to resiliently force said element back to said inactive position after said element has been temporarily moved to said active position;

means securing one of said sheath mounting fittings to said brackets; and means securing a respective one of said cable attachment fittings to said lock portion engaging element for temporarily applying pulling force to said element for temporarily moving said element from said inactive position thereof to said active position thereof; said lever end portion comprising:

a housing having an outer side and an inner side; means providing a recess being bordered by a bezel; means defining a slot through said housing, said slot intersecting said recess;

a lever protruding through said recess so that an outer portion thereof is juxtaposed with said outer side of said housing and an inner portion thereof is juxtaposed with said inner side of said housing;

trunnion means and hinge barrel means provided on said housing, adjacent said slot, and on an intermediate portion of said lever, between said inner and outer portions of said lever, whereby said lever is pivotally movable on said trunnion means between an inactive position in which said outer portion of said lever is substantially completely recessed in said recess and bordered by said bezel, and an active position in which said outer portion slants out of said recess beyond said bezel;

means for mounting said housing to said panel in bridging relation to said slot through said panel from one face of said panel, so that said inner portion of said lever is exposed internally of the seat and arm frame unit through said slot through said panel;

means for securing the other of said sheath mounting fittings in fixed relation to said bracket;

means securing the other of said cable attachment fittings to said inner portion of said lever at such a distance from said hinge barrel means, that pivotal movement of said lever from said inactive position thereof to said active position thereof reversibly pulls said flexible cable longitudinally in said sheath by an amount which moves said element from inactive position thereof to said active position thereof; and resilient means effectively secured between said lever and said bracket and operative for tending to maintain said lever in said inactive position thereof and to resiliently force said lever back to said inactive position thereof after said lever has bee temporarily moved to said active position thereof.

2. The mechanism lock release actuator of claim 1, wherein:

said means for mounting said housing to said panel comprises:

a mounting plate having edge means;

means for securing said mounting plate on an opposite face of said panel in bridging relation to said slot through said panel;

hook means formed on said inner side of said bracket and hooked around said edge means of said mounting plate; and a fastener secured through said outer side of said bracket into said mounting plate.

3. The mechanism lock release actuator of claim 2, further including:

surface means provided on said inner portion of said lever and arranged to engage edge means on said mounting plate for defining an outer limit to rotation of said lever from said inactive position thereof to said active position thereof.

4. The mechanism lock release actuator of claim 1, wherein:

said outer portion of said lever comprises an easily graspable bar, which, when said lever is in said inactive position thereof, crosses said recess between spaced locations on said bezel.

5. The mechanism lock release actuator of claim 4, wherein:

said bar is constituted by a respective portion of a ring-shaped handle.

6. A recliner chair, comprising:

a seat and arm frame unit supported on a base by an occupant force operated mechanism which is reversibly movable between a closed position in which the recliner chair is erect and at least one at least partially open position in which an ottoman mounted to the mechanism is raised and forwardly thrust from a location stowed under a forward edge of a seat cushion of the seat and arm frame unit, in which the seat and arm frame unit includes at least one arm constituted at least in part by a panel having a slot provided therethrough, and in which a mechanism lock must be released by movement of a lock portion of said mechanism a certain distance in a certain direction before said occupant force can be effectively applied to move said mechanism from said closed position to said at least partially open position; and a mechanism lock release actuator having a lock end portion, a lever end portion and a flexible cable assembly;

said flexible cable assembly including:

a flexible sheath having two opposite ends;

a respective sheath mounting fitting provided at each end thereof;

a flexible cable longitudinally slidably received in said sheath and having two opposite end portions respectively protruding out of opposite ends of said sheath; and a respective cable attachment fitting secured on each end portion of said flexible cable;

said lock end portion comprising:

a bracket and means mounting said bracket in fixed relation to said seat and arm frame unit adjacent said lock portion of said mechanism;

a lock portion engaging element and means mounting said element to said bracket for movement along a path between an inactive position, and an active position in which said element, having engaged said lock portion of said mechanism has forceably moved said lock portion of said mechanism said certain distance in said certain direction;

resilient means effectively secured between said bracket and said element and operative for tending to maintain said element in said inactive position and to resiliently force said element back to said inactive position after said element has been temporarily moved to said active position;

means securing one of said sheath mounting fittings to said brackets; and means securing a respective one of said cable attachment fittings to said lock portion engaging element for temporarily applying pulling force to said element for temporarily moving said element from said inactive position thereof to said active position thereof; said lever end portion comprising:

a housing having an outer side and an inner side; means providing a recess being bordered by a bezel; means defining a slot through said housing, said slot intersecting said recess;

a lever protruding through said recess so that an outer portion thereof is juxtaposed with said outer side of said housing and an inner portion thereof is juxtaposed with said inner side of said housing;

trunnion means and hinge barrel means provided on said housing, adjacent said slot, and on an intermediate portion of said lever, between said inner and outer portions of said lever, whereby said lever is pivotally movable on said trunnion means between an inactive position in which said outer portion of said lever is substantially completely recessed in said recess and bordered by said bezel, and an active position in which said outer portion slants out of said recess beyond said bezel;

means mounting said housing to said panel in bridging relation to said slot through said panel from one face of said panel, so that said inner portion of said lever is exposed internally of the seat and arm frame unit through said slot through said panel;

means securing the other of said sheath mounting fittings in fixed relation to said bracket;

means securing the other of said cable attachment fittings to said inner portion of said lever at such a distance from said hinge barrel means, that pivotal movement of said lever from said inactive position thereof to said active position thereof reversibly pulls said flexible cable longitudinally in said, sheath by an amount which moves said element from said inactive position thereof to said active position thereof; and resilient means effectively secured between said lever and said bracket and operative for tending to maintain said lever in said inactive position thereof and to resiliently force said lever back to said inactive position thereof after said lever has been temporarily moved to said active position thereof.

* * * * *